US007021849B2

(12) United States Patent
Ramet

(10) Patent No.: US 7,021,849 B2
(45) Date of Patent: Apr. 4, 2006

(54) APPLICATOR DEVICE FOR A PRODUCT, PARTICULARLY A COSMETIC PRODUCT

(75) Inventor: Marc Ramet, Asnieres (FR)

(73) Assignee: L'Oreal, Paris (FR)

( * ) Notice: Subject to any disclaimer, the term of this patent is extended or adjusted under 35 U.S.C. 154(b) by 90 days.

(21) Appl. No.: 10/733,281

(22) Filed: Dec. 12, 2003

(65) Prior Publication Data

US 2004/0213626 A1 Oct. 28, 2004

Related U.S. Application Data

(60) Provisional application No. 60/441,323, filed on Jan. 22, 2003.

(30) Foreign Application Priority Data

Dec. 12, 2002 (FR) ..... 02 15748

(51) Int. Cl.
*B43K 5/06* (2006.01)
*B43K 21/00* (2006.01)

(52) U.S. Cl. ..... 401/176; 401/82

(58) Field of Classification Search ..... 401/176, 401/179, 178, 55, 59, 60, 95, 82; 222/386
See application file for complete search history.

(56) References Cited

U.S. PATENT DOCUMENTS 2,085,446 A * 6/1937 Philippe ..... 222/386
2,458,120 A * 1/1949 Volpini ..... 401/12
2,502,716 A 4/1950 Greene
2,568,688 A * 9/1951 Shatkin ..... 401/82
2,755,503 A * 7/1956 Whetstone ..... 401/176
3,443,874 A 5/1969 Pelli et al.
4,023,912 A * 5/1977 Mahler et al. ..... 401/82
6,086,276 A 7/2000 Gueret

FOREIGN PATENT DOCUMENTS

| | | |
|---|---|---|
| DE | 196 47 617 | 5/1998 |
| EP | 0 503 324 | 9/1992 |
| FR | 986178 | 7/1951 |
| FR | 1 524 080 | 5/1968 |

* cited by examiner

*Primary Examiner*—David J. Walczak
(74) *Attorney, Agent, or Firm*—Oblon, Spivak, McClelland, Maier & Neustadt, P.C.

(57) ABSTRACT

An applicator device in which a product is held within a recess at least partially defined by a support and a lateral enclosure which is slidably mounted on the support. The lateral enclosure includes at least one opening at an end opposite to the support such that as the lateral enclosure is moved relative to the support the product is progressively exposed. Where the product is a solid or stick form, the opening of the lateral enclosure can be provided across the entire cross-section of the lateral enclosure. Where the product is a semi-solid or a viscous liquid, such as a gel, a plurality of openings can be provided, with the product urged through the plurality of openings as the lateral enclosure is moved relative to the support.

34 Claims, 3 Drawing Sheets

APPLICATOR DEVICE FOR A PRODUCT, PARTICULARLY A COSMETIC PRODUCT

CROSS-REFERENCE TO RELATED APPLICATIONS

This document claims priority to French Application Number 02 15748, filed Dec. 12, 2002, and U.S. Provisional Application No. 60/441,323, filed Jan. 22, 2003, the entire contents of which are hereby incorporated by reference.

FIELD OF THE INVENTION

The present invention relates to an applicator device intended for the topical application of a product having a cosmetic or dermato-pharmaceutical action, such as a deodorant product, a moisturizing product, a sun protection product, a lipstick, a foundation, an eye shadow, a hair coloring or other hair care product, etc. The invention is particularly advantageous in providing an applicator device for a solid product such as a product in stick form or a fluid product having an applicator wall permeable to the product.

BACKGROUND OF THE INVENTION

Discussion of Background

Products in stick form, in particular lipstick, are typically packaged in devices of the type including a cup containing the formulation to be applied and capable, in response to an actuating command, of moving axially inside a sleeve between a storage position and an application position. The mechanism employed to actuate the axial displacement of the cup can take various forms. It can include a threaded rod below the cup engaging a nut, with the mechanism actuated by an operating element formed by a thumbwheel disposed under the sleeve. Alternatively, the mechanism can take the form of a helical ramp formed in a wall of the sleeve and in which a lug carried by the cup moves. Products in stick form, notably deodorant products, can be packaged in other types of devices incorporating a piston sliding inside a sleeve, such as that described, for example, in document U.S. Pat. No. 6,086,276. The piston can be actuated by a threaded rod engaging with a nut, or by a ratchet mechanism.

These types of mechanisms are relatively complicated to make and include a relatively large number of components.

Document FR 986 178 describes a casing for a lipstick in which the actuating mechanism is simplified. In particular, the casing includes a tube open at both ends in which a cup containing the lipstick is able to slide. The cup passes through the lower end of the tube in a manner such that the user can push it, causing the lipstick to move upwardly within the tube to emerge from the upper end. A closure cap is provided for attachment in a reversible manner on the tube. However, to ensure that the cap is sufficiently long to avoid crushing the lipstick if the cup is pushed down to its maximum extent when the housing is closed, the case must have a relatively large lengthwise dimension, equal to three times the length of the lipstick. In addition, because the cup carrying the product projects beyond the lower end of the tube, the product can be moved relative to the tube even when the case is in the closed position, which is not desirable particularly in the case of a creme stick.

Document EP0 503 324 describes a dispenser of the same type for dispensing a fluid product. The upper end of the tube is closed by a cap fixed on the tube and has a product outlet aperture which can be closed by a plug.

To reduce the size of such a casing, casings have already been proposed in which the cup is flush with the lower end of the tube. With such an arrangement, the user pushes the cup by the bottom of the tube to cause the product to emerge via the upper end of the tube. To apply the product, the user holds the tube and applies the solid product to the area desired. However, because the product is not fixed in relation to the tube, it is necessary for the cup to slide with sufficient friction on the inner wall of the tube so that the product does not recede back into the tube during application. However, if the friction is too great, the user has difficulty in pushing the cup inside the tube to cause the product to emerge before application.

Devices of the same type have been described in documents FR 1 524 080 and U.S. Pat. No. 3,443,874.

SUMMARY OF THE INVENTION

It is an object of the invention to provide an applicator device for a product which avoids at least some, and preferably each of the drawbacks of the prior art.

It is a particular object of the invention to provide an applicator device for a product which includes a propelling mechanism for the product that is simple to make and use.

It is a further object of the invention to provide an applicator device that is compact in size and at the same time avoids the risk of damaging the product when it is in stick form.

It is another object of the invention to provide an applicator device which prevents emergence of the product when the device is in the closed position.

According to the invention, these objects are achieved by making an applicator device for a product, notably a cosmetic product, having a longitudinal axis X, including a support and a lateral enclosure delimiting at least partially with the support a recess for the product. One end of the recess opposite the support forms at least one opening, with the enclosure being mounted on the support so as to be capable of sliding on axis X by moving relative to the product in the direction of the support. The device also includes a closure cap designed to be fixed in a reversible manner on the support.

The device is relatively simple to use in that the user simply has to slide the enclosure towards the support to cause the product to emerge from the recess through the opening before applying it to the desired area. In addition, when the cap is attached to the support, the cap covers the enclosure so that it is no longer accessible such that the enclosure and the product cannot move inside the device in the closed position. In addition, the device presents a relatively compact lengthwise dimension because it can have a length equal to, for example, only twice the length of the recess containing the product.

According to a first embodiment, the end of the recess can delimit an opening of transverse cross-section substantially identical to the transverse cross-section of the enclosure, and capable of allowing the passage of the product in stick form.

According to a second embodiment, the end of the recess can include a wall permeable to the product in fluid form. The permeable wall includes at least one opening and preferably a plurality of openings, capable of allowing the passage of the product in fluid form. The size of the openings is chosen in relation to the viscosity of the product so that the product cannot run out through the openings by simple gravity. The openings can, for example, be the pores of a porous material or the spaces between the fibers of a fibrous material.

The support can include a peripheral lip capable of sliding in a leaktight manner on the inner surface of the enclosure. Alternatively, an O-ring seal can be provided on the support.

The support can include a lower end which at least a part projects axially beyond the cap when the cap is in the closed position. This end serves in particular to facilitate opening of the device, because it can be grasped by the user when separating the cap and the support. The support can be configured so that the closure cap can be fixed thereto in a reversible manner on the support.

The support can include a transverse wall forming the bottom of the recess for the product, the transverse wall being traversed by at least one aperture. The aperture can be used to introduce the product through the bottom of the recess to fill the recess.

The enclosure can include a flange on its inner surface designed to bear axially against two portions of the support in two end positions.

The product can be a cosmetic product, such as a deodorant product, a moisturizing product, a sun protection product, a lipstick, a foundation, an eye shadow or other make-up product, a hair coloring or other hair care product, etc.

BRIEF DESCRIPTION OF THE DRAWINGS

Other characteristics and advantages of the invention will become apparent from the following detailed description, particularly when considered in conjunction with the drawings in which.

DETAILED DESCRIPTION OF THE PREFERRED EMBODIMENTS

Figure 1:
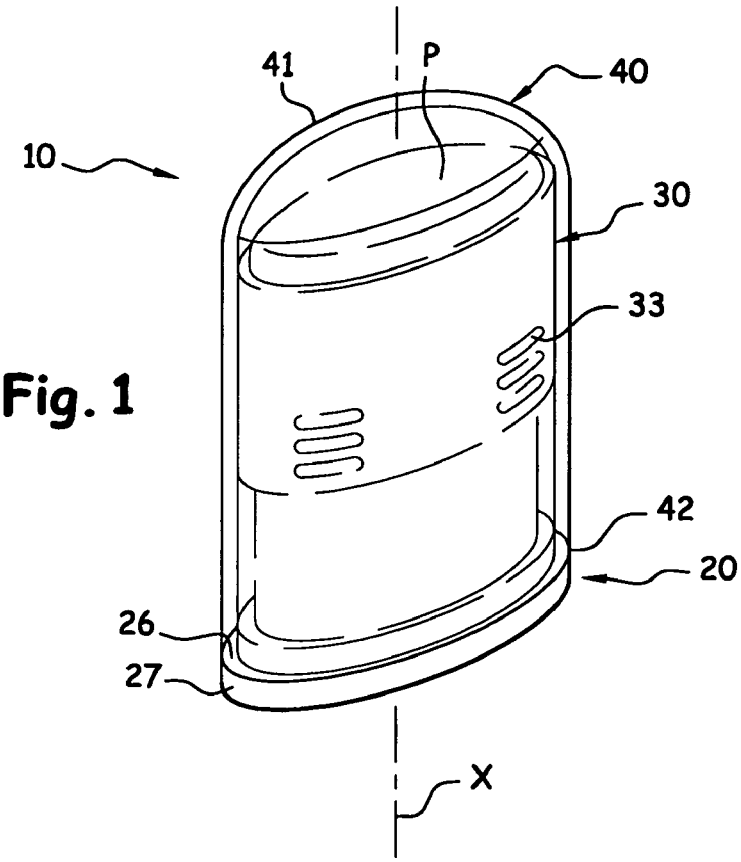
FIG. 1 illustrates a perspective view of an applicator device according to the invention, in the closed position.
Figure 2:
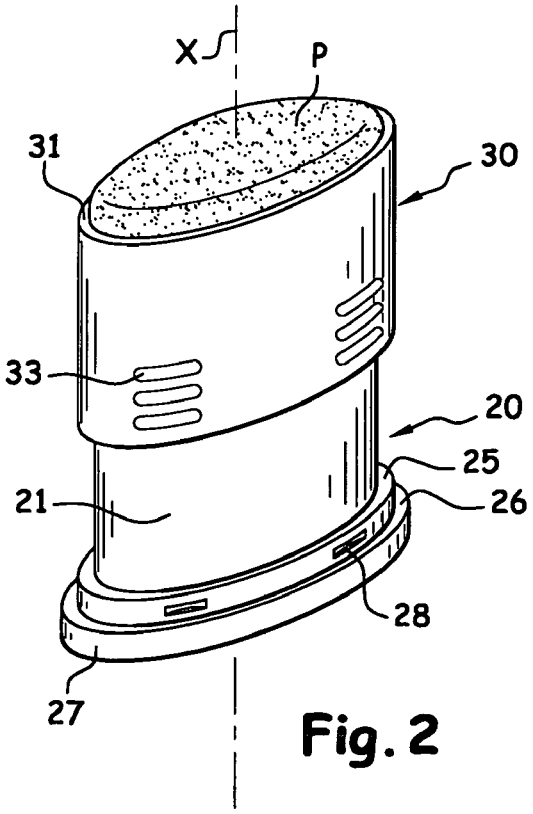
FIGS. 2 to 4 illustrate different perspective views of the device in FIG. 1, with the cap removed.
Figure 3:
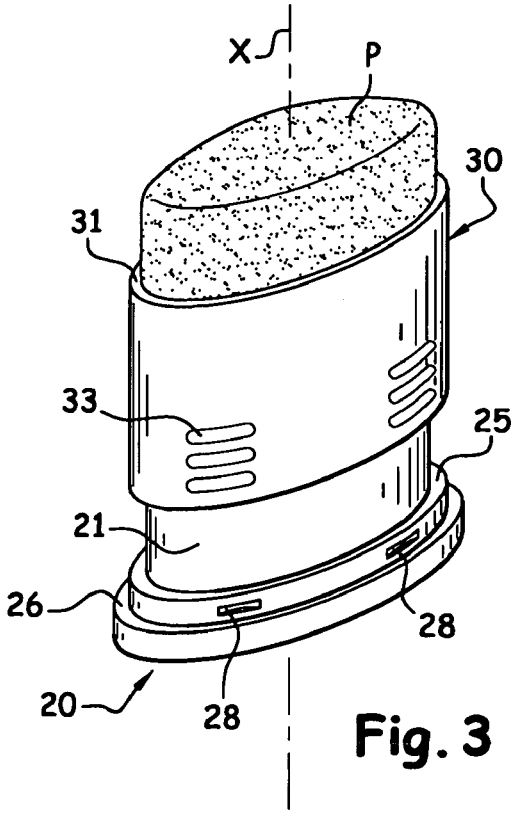
Figure 4:
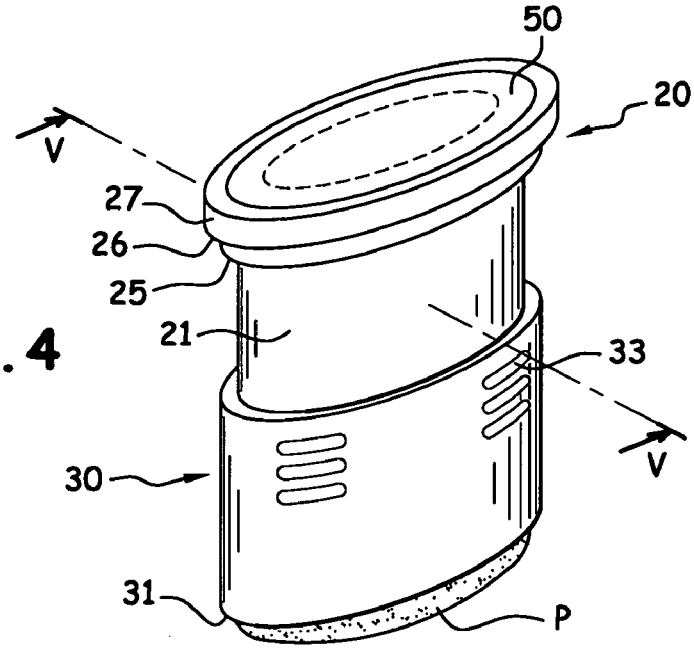
Figure 5:
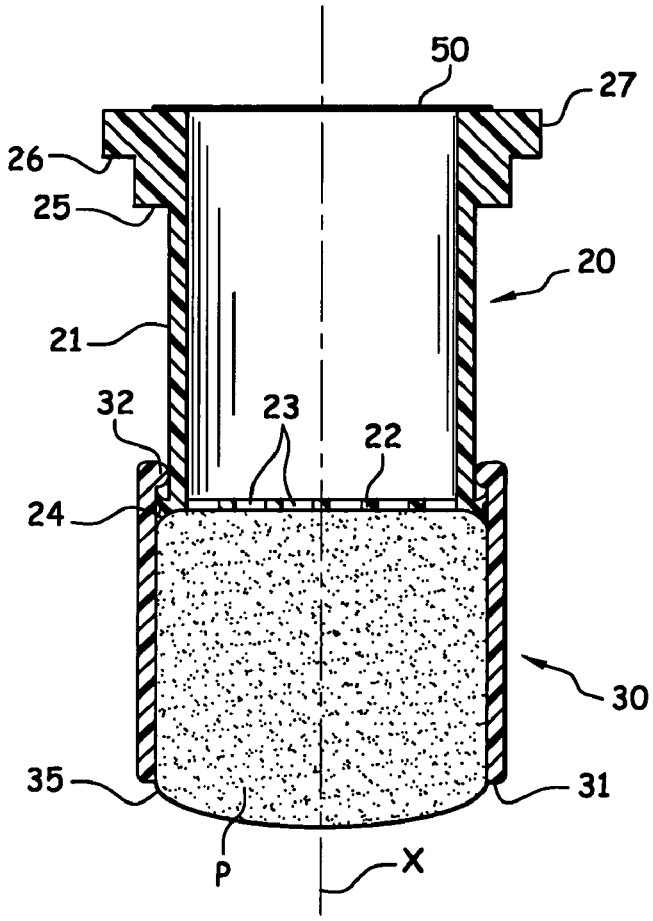
FIG. 5 is a cross-sectional view of the device illustrated in FIG. 4.

FIGS. 1 to 5 illustrate a first example of an applicator device 10 according to the invention. The applicator device is, for example, intended for the application of a cosmetic product, in particular a deodorant product, and is presented in the form of a solid stick. As noted earlier the invention can also be advantageous for other cosmetic products such as a sun protection product, a lipstick or other make-up, or a hair care product such as a hair color product.

In the illustrated example, the device 10 has a longitudinal axis X and an elliptical transverse-cross section. The device includes a support 20 and an enclosure 30 capable of sliding axially relative to each other, and a closure cap 40 covering the entire assembly. The elliptical shape in transverse cross-section can be preferred because it permits only linear movement between the enclosure and the support. However, it is to be understood that other shapes can be used. Preferably, the cross-section has a non-circular shape to prevent or minimize relative movement such as rotational movement between the enclosure and the support other than the desired linear movement. Alternatively, the transverse cross-section can be circular and an anti-rotation system can be provided on the support and the enclosure, such as for example a lug sliding in an axial groove. Of course, the device can also be circular in transverse cross-section and need not include an anti-rotation system, thus allowing rotational movement between the enclosure and the support.

The support 20 is preferably a hollow body formed by a sidewall 21 which extends parallel to the axis X. The sidewall 21 is closed at its upper end by a perforated transverse wall 22, the wall being traversed by several apertures 23 whose function will be explained below. Alternatively, the wall 22 can be traversed by a single aperture 23. The transverse wall 22 includes a sealing lip 24 at its periphery, designed to slide in the enclosure. The lip slides in the enclosure with sufficient and desired frictional force to prevent the enclosure from moving by simple gravity for example, while at the same time enabling the user to move it easily. The sidewall 21 includes a first radial step 25 facing outward, in proximity to its lower end. This first step 25 can serve as a lower stop for the enclosure 30. A second radial step 26 facing outward, larger than the first, is provided under the first. Several ribs 28 are provided on the outer surface of the sidewall 21, between the two steps 25 and 26. In the illustrated embodiment, four ribs 28, spaced apart from each other, are formed at the same axial height. These ribs 28 serve to attach the closure cap 40 in a reversible manner on the support.

A closure plate 50 is fixed to the bottom of the support so as to close off the underside of the support in a leaktight manner. The closure plate is, for example, heat sealed to the bottom edge of the wall 21 of the support. The closure plate can alternately be, for example, an adhesive label or a plug designed to snap into the base of the support.

An enclosure 30 formed by a sleeve extending parallel to the axis X is mounted on the support 20 so as to be capable of sliding on a part of the support between two positions. The enclosure 30 has a transverse cross-section substantially larger than that of the wall 21 of the support on which it slides. The enclosure 30 is open at its two ends, with the upper end 31 delimiting an opening 35 allowing the product to pass through. The lower end of the enclosure 30 incorporates an inward-facing flange 32. With the enclosure in the highest position relative to the support, the flange 32 bears axially against the peripheral lip 24. With the enclosure in the lowest position, the flange 32 bears axially against the step 25 in the sidewall of the support. Thus, the enclosure is movable from a first position at which the volume within the recess (defined by the enclosure and the support) is a maximum to a second position at which the volume of the recess is a minimum. As the enclosure is moved toward the second position, the product is progressively exposed for application. Also, as can be appreciated from the drawings, the lateral enclosure progressively covers a portion of the support as the lateral enclosure moves from the first position toward the second position. The product in the preferred embodiments illustrated in FIGS. 1–7 is substantially fixed axially with respect to the support with the lateral enclosure 30 slidable over the support to progressively expose the product. Ridges 33 are formed on the outer surface of the enclosure to provide a grip for the user's fingers and to enable the user to slide the enclosure relative to the support without the fingers slipping on the enclosure. Preferably, several sets of ridges 33 are formed opposite each other on each major width of the enclosure so as to ensure a good gripping surface. The ridges can be replaced by roughened surfaces or by slight concavities designed to receive the user's fingers.

A closure cap 40 in the form of a casing is provided to cover the support-product-enclosure assembly. This casing is also elliptical in transverse cross-section. It is closed at its upper end by a domed portion 41 and is open at its lower end 42. The inner surface of the cap includes serrations, not shown, in proximity to its lower end, forming a reversible means of attachment of the cap to the support in conjunction with the ribs 28 provided on the support. Alternatively, serrations can be provided on the support, which engage with ribs provided on the inner surface of the cap to form the reversible means of attachment of the cap to the support. As a further alternative, the cap can be fixed to the support by lateral compression or pressure.

Figure 6:
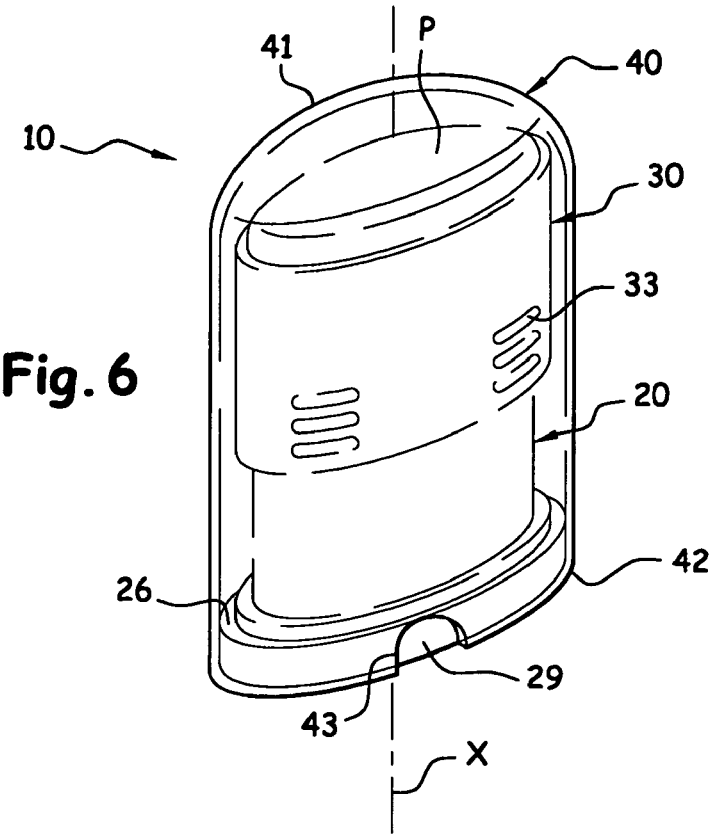
FIG. 6 is a variant of the device according to the invention.

With the cap in the closed position, the transverse cross-section of the wall 21 at the level of the step 26 is substantially the same as that of the cap, or greater so that the wall 21 projects laterally beyond the cap 40. Thus, with the cap in the closed position, the cap can abut against the step 26 but does not cover all of the lower end 27 of the support from this step 26 so that this lower end 27 is accessible to the user in the closed position. Alternatively, the cap can be arranged to partly envelop the lower end 27 of the support and to include a slot or notch 43 (FIG. 6). Preferably two or more slots or notches 43 are provided. The slots 43, as illustrated in FIG. 6, are formed in the lower end 42 of the cap to expose two portions 29 of the support which can be grasped by the user. Although only one slot is shown in FIG. 6, as one would understand, another slot can be provided on the opposite side of the container.

The device is made as follows. First, the support 20, the enclosure 30 and the cap 40 are each formed. Preferably the support 20, the enclosure 30 and the cap 40 are each formed as a one-piece molding of a thermoplastic material, for example a polypropylene or a polyethylene. However, it is to be understood that the support, the enclosure and/or the cap could also be formed from several components assembled together. The enclosure is mounted on the support in the raised position, i.e., such that the flange 32 of the enclosure bears against the sealing lip 24 of the support. The cap 40 is then attached in a reversible manner to the support. The device is then filled with product in fluid form by pouring via the bottom of the support, i.e. through the opening delimited by the lower edge of the wall 21 of the support. The product then flows through the apertures 23 in the transverse wall 22 of the support to fill the recess delimited by the enclosure 30, the domed wall 41 of the cap and the transverse wall 22 of the support. As an alternative to using the domed portion of the cap to define an end stop for filling the product, a small capsule or cover can be provided which is attached to the upper edge of the enclosure 30 and which delimits the product volume to be filled in conjunction with the enclosure and the transverse wall 22. Preferably, a dome-shaped cover is chosen so as to impart a domed application surface to the product. As the product dries, it forms a stick of which the bottom is integral with the transverse wall 22 of the support. Filling is a relatively simple operation to perform as there is no obstacle impeding access to the aperture 23, notably by virtue of the absence of any mechanism to actuate the stick in the base of the device.

To use the device, the user separates the cap from the support by holding the lower end 27 or 29 of the sidewall of the support and moving the cap away from the support. On first use, the domed portion of the product stick projects axially beyond the enclosure even if the enclosure is in the high position relative to the support. The user simply has to apply this domed portion of the stick to the area of the body to be treated. After several uses, the product stick no longer projects axially beyond the enclosure 30. The user can then move the enclosure 30 axially in the direction of the support so as to expose the upper portion of the product. To do this, the user holds the support 20 with one hand and positions the fingers of the other hand, or the same hand, on the ridges 33 and pushes the enclosure down on the support so as to cause the lip 24 to slide on the inner surface of the enclosure 30. Once the upper portion of the stick projects beyond the enclosure, the user can apply the product to the body by holding the support 20 by itself or with the enclosure. When the user is holding the support which is fixed relative to the product, during application of the product to the surface to be treated, no relative movement is possible between the product and the enclosure during the application, in contrast to the devices discussed previously wherein the user must hold the enclosure during application. In the case where the user has moved the enclosure too far down, i.e. an excessively large portion of the stick is protruding from the enclosure, all the user needs to do is move the enclosure back up relative to the support. After each application, the cap can be replaced on the support. As the cap is attached to the support to which the product is permanently fixed, there is no risk of damaging the upper portion of the stick when it is replaced on the support. With continuing use, the stick diminishes in height and the enclosure must be moved toward the support to cause the stick to emerge from the upper end of the enclosure. At the end of use, the enclosure is in its lowest position so that the lower portion of the stick can be applied.

Figure 7:
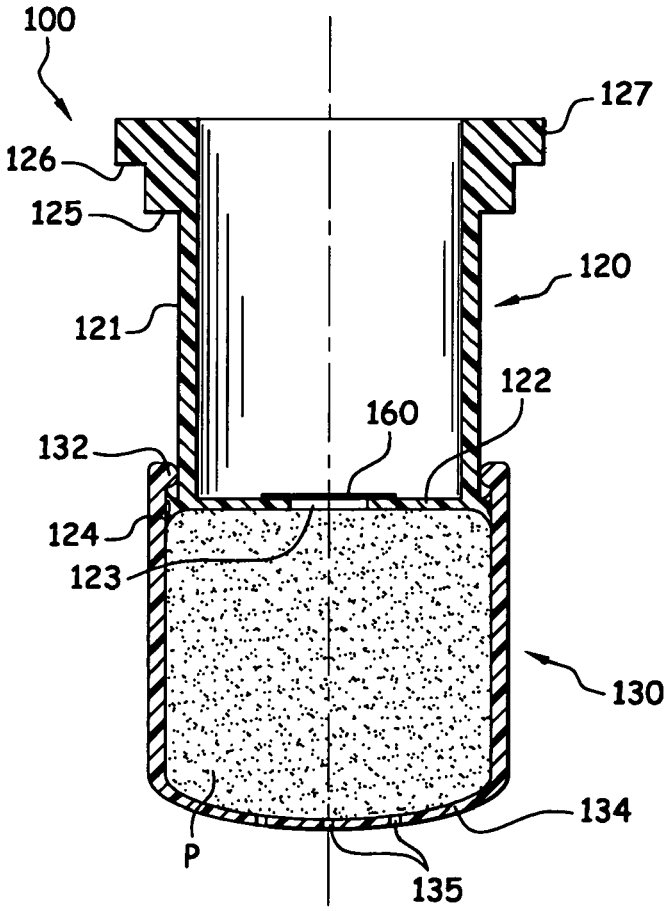
FIG. 7 is a cross-sectional view of a second embodiment of the device according to the invention.

The device shown in FIG. 7 illustrates a variant of the applicator device according to the invention. The reference numbers have been incremented by 100 relative to those of the first embodiment just described. In this embodiment, the product is in a liquid or semi-liquid form. This can include a gel, for example.

This device 100 differs from that just described in that the enclosure 130 in this instance is closed at its upper end 134 by a domed transverse wall permeable to the product. The upper end 134 is, for example, traversed by openings 135 which, preferably, do not allow the product to run out by gravity when the device is in the upturned position. In addition, the transverse wall 122 is in this instance traversed by a single aperture 123 which, after the product has been filled, is closed by a plate 160 heat sealed to the lower surface of the transverse wall 122, or by a plug. Alternatively, several apertures 123 can be provided.

This device is used in the same manner as that just described, except that before each use, including the first, the user must slide the enclosure 130 by a small amount towards the support 120 so as to reduce the volume of the recess containing the product and thus expel the product through the openings 135. The product then emerges at the external surface of the domed transverse wall 134 forming the product application surface which the user is then able to apply to his/her body in order to deposit the product.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An applicator device for a product in which the device has a longitudinal axis X, the device comprising:

a support;

a lateral enclosure delimiting at least partially with the support a recess for the product, the lateral enclosure including at least one opening to provide access to the product at one end of the recess opposite the support, the enclosure being mounted on the support so as to be capable of sliding in the direction of axis X to move the enclosure relative to the product in the direction of the support; and a closure cap removably mountable on the support;

wherein said support includes a first step, and wherein said lateral enclosure is slidable relative to said support between a first position at which a volume of said recess is at a maximum and a second position at which a volume of said recess is at a minimum, and wherein said lateral enclosure abuts against said first step in said second position.

2. A device according to claim 1, wherein the one end of the recess delimits an opening having a transverse cross-section substantially identical to a transverse cross-section of the enclosure to thereby allow a product in stick form to pass through said one end.

3. An applicator device for a product in which the device has a longitudinal axis X, the device comprising:

a support;

a lateral enclosure delimiting at least partially with the support a recess for the product, the lateral enclosure including at least one opening to provide access to the product at one end of the recess opposite the support, the enclosure being mounted on the support so as to be capable of sliding in the direction of axis X to move the enclosure relative to the product in the direction of the support; and a closure cap removably mountable on the support;

wherein the one end of the recess includes a wall which is permeable to a product in fluid form.

4. An applicator device for a product in which the device has a longitudinal axis X, the device comprising:

a support;

a lateral enclosure delimiting at least partially with the support a recess for the product, the lateral enclosure including at least one opening to provide access to the product at one end of the recess opposite the support, the enclosure being mounted on the support so as to be capable of sliding in the direction of axis X to move the enclosure relative to the product in the direction of the support; and a closure cap removably mountable on the support;

wherein the support includes a peripheral lip which slides in a leaktight manner on an inner surface of the enclosure.

5. A device according to claim 4, wherein the support includes a lower end of which at least a part projects axially beyond the cap when the cap is mounted in a closed position on said support.

6. A device according to claim 5, wherein the support includes attachment means to removably fix the closure cap on the support.

7. A device according to claim 6, wherein the support includes a transverse wall forming a bottom of the recess for the product, the transverse wall including at least one aperture extending therethrough.

8. A device according to claim 7, wherein the enclosure includes a flange on its inner surface, and wherein said enclosure is movable from a first end position to a second end position, and further wherein said flange bears against a first portion of said support at said first end position and said flange bears against a second portion of said support at said second end position.

9. A device according claim 8, wherein the product is one of a deodorant product, a moisturizing product, a sun protection product, a lipstick, a foundation, an eye shadow, a hair care product, and a hair coloring product.

10. A device according to claim 1, wherein the support includes a lower end of which at least a part projects axially beyond the cap when the cap is mounted in a closed position on said support.

11. A device according to claim 1, wherein the support includes attachment means to removably fix the closure cap on the support.

12. An applicator device for a product in which the device has a longitudinal axis X, the device comprising:

a support;

a lateral enclosure delimiting at least partially with the support a recess for the product, the lateral enclosure including at least one opening to provide access to the product at one end of the recess opposite the support, the enclosure being mounted on the support so as to be capable of sliding in the direction of axis X to move the enclosure relative to the product in the direction of the support; and a closure cap removably mountable on the support;

wherein the support includes a transverse wall forming a bottom of the recess for the product, the transverse wall including at least one aperture extending therethrough.

13. An applicator device for a product in which the device has a longitudinal axis X, the device comprising:

a support;

a lateral enclosure delimiting at least partially with the support a recess for the product, the lateral enclosure including at least one opening to provide access to the product at one end of the recess opposite the support, the enclosure being mounted on the support so as to be capable of sliding in the direction of axis X to move the enclosure relative to the product in the direction of the support; and a closure cap removably mountable on the support;

wherein the enclosure includes a flange on its inner surface, and wherein said enclosure is movable from a first end position to a second end position, and further wherein said flange bears against a first portion of said support at said first end position and said flange bears against a second portion of said support at said second end position.

14. A device according to claim 1, wherein the product is one of a deodorant product, a moisturizing product, a sun protection product, a lipstick, a foundation, an eye shadow, a hair care product, and a hair coloring product.

15. A device according to claim 1, wherein said product is a cosmetic product.

16. A device according to claim 1, wherein said support further includes a second step, and wherein said cap abuts against said second step when said cap is mounted on said support.

17. A device according to claim 1, wherein said cap includes at least one notch such that when said cap is mounted on said support a portion of said support is exposed through said at least one notch.

18. A device according to claim 1, wherein a portion of said support is exposed when said lateral enclosure is in said first position and said lateral enclosure progressively covers said portion of said support as said lateral enclosure is moved from said first position toward said second position.

19. A device according to claim 1, wherein said lateral enclosure has a non-circular cross-section.

20. An applicator device comprising:

a support;

a lateral enclosure at least partially delimiting a recess with said support, said lateral enclosure including at least one opening at a first end of said recess with said support closing a second end of said recess, and wherein said lateral enclosure is mounted on said support and is axially slidable relative to said support between a first position at which a volume of said recess is a maximum and a second position at which the volume of said recess is a minimum, and wherein a portion of said support is exposed when said lateral enclosure is in said first position and said lateral enclosure progressively covers said portion of said support as said lateral enclosure is moved from said first position toward said second position;

a product disposed in said recess such that as said lateral enclosure is moved from said first position toward said second position said product is progressively exposed for application through said at least one opening; and a cap removably mountable on said support and wherein when said cap is mounted on said support said cap covers said lateral enclosure.

21. A device according to claim 20, wherein said support includes a first step, and wherein when said lateral enclosure is in said second position said lateral enclosure abuts against said first step.

22. A device according to claim 21, wherein said support further includes a second step, and wherein said cap abuts against said second step when said cap is mounted on said support.

23. A device according to claim 21, wherein said portion of said support is disposed above said first step, and wherein said portion is completely covered by said lateral enclosure when said lateral enclosure is in said second position, and further wherein said second step is not covered by said lateral enclosure when said lateral enclosure is in said second position.

24. A device according to claim 21, wherein said cap includes at least one notch such that when said cap is mounted on said support, part of said support is exposed through said at least one notch.

25. An applicator device comprising:

a support;

a lateral enclosure at least partially delimiting a recess with said support, said lateral enclosure including at least one opening at a first end of said recess with said support closing a second end of said recess, and wherein said lateral enclosure is mounted on said support and is axially slidable relative to said support between a first position at which a volume of said recess is a maximum and a second position at which the volume of said recess is a minimum, and wherein a portion of said support is exposed when said lateral enclosure is in said first position and said lateral enclosure progressively covers said portion of said support as said lateral enclosure is moved from said first position toward said second position; and a product disposed in said recess such that as said lateral enclosure is moved from said first position toward said second position said product is progressively exposed for application through said at least one opening;

wherein said support includes a first step, and wherein when said lateral enclosure is in said second position said lateral enclosure abuts against said first step.

26. An applicator device according to claim 25, wherein the product provided in the recess comprises one of a deodorant product, a moisturizing product, a sun protection product, a lipstick, a foundation, an eyeshadow, a hair care product, and a hair coloring product.

27. A device according to claim 25, wherein said lateral enclosure includes an inwardly protruding flange, and wherein said support includes a lip, and further wherein when said lateral enclosure is in said first position said inwardly protruding flange abuts against said lip.

28. A device according to claim 20, wherein said lateral enclosure includes an inwardly protruding flange, and wherein said support includes a lip, and further wherein when said lateral enclosure is in said first position said inwardly protruding flange abuts against said lip.

29. An applicator device comprising:

a support;

a lateral enclosure at least partially delimiting a recess with said support, said lateral enclosure including at least one opening at a first end of said recess with said support closing a second end of said recess, and wherein said lateral enclosure is mounted on said support and is axially slidable relative to said support between a first position at which a volume of said recess is a maximum and a second position at which the volume of said recess is a minimum, and wherein a portion of said support is exposed when said lateral enclosure is in said first position and said lateral enclosure progressively covers said portion of said support as said lateral enclosure is moved from said first position toward said second position; and a product disposed in said recess such that as said lateral enclosure is moved from said first position toward said second position said product is progressively exposed for application through said at least one opening;

wherein said support includes a transverse wall at said second end of said recess, said wall including at least one opening extending therethrough for filling said product into said recess.

30. A device according to claim 20, wherein said product comprises one of a deodorant product, a moisturizing product, a sun protection product, a lipstick, a foundation, an eye shadow, a hair care product, and a hair coloring product.

31. A device according to claim 20, wherein said product is substantially fixed in an axial direction with respect to said support.

32. A device according to claim 31, further including means for preventing rotation of said product with respect to said support.

33. A device according to claim 20, wherein said lateral enclosure has a non-circular cross-section.

34. An applicator device according to claim 20, wherein said support includes a peripheral lip which slides in a leaktight manner on an inner surface of the lateral enclosure as the lateral enclosure is moved between said first position and said second position.

* * * * *